United States Patent [19]

Simons

[11] 4,394,822

[45] Jul. 26, 1983

[54] HIGH REDUCTION METHOD AND APPARATUS FOR CONTINUOUSLY HOT ROLLING PRODUCTS

[75] Inventor: Keith F. Simons, Worcester, Mass.

[73] Assignee: Morgan Construction Company, Worcester, Mass.

[21] Appl. No.: 257,029

[22] Filed: May 6, 1981

Related U.S. Application Data

[63] Continuation-in-part of Ser. No. 156,940, Jun. 6, 1980, abandoned.

[51] Int. Cl.[3] ..... B21B 13/12

[52] U.S. Cl. ..... 72/235; 72/366

[58] Field of Search ..... 72/234, 235, 250, 284, 72/365, 366

[56] References Cited

U.S. PATENT DOCUMENTS

| | | | |
|---|---|---|---|
| 1,199,080 | 9/1916 | Jones | 72/203 |
| 1,851,063 | 3/1932 | Ramsey | 72/235 |
| 2,811,060 | 10/1957 | Sendzimir | 72/190 |
| 3,114,276 | 12/1963 | Uebing et al. | 72/184 |
| 3,693,393 | 9/1972 | Nellen et al. | 72/226 |
| 3,718,020 | 2/1973 | Leitner | 72/78 |
| 3,735,617 | 5/1973 | Bretschneider | 72/78 |
| 4,019,361 | 4/1977 | Sebardt | 72/252 |
| 4,050,280 | 9/1977 | Sayer | 72/234 |
| 4,074,557 | 2/1978 | Yanagimoto et al. | 72/206 |
| 4,106,318 | 8/1978 | Yanagimoto et al. | 72/234 |
| 4,307,595 | 12/1981 | Nishikubo et al. | 72/234 |

FOREIGN PATENT DOCUMENTS

| | | | |
|---|---|---|---|
| 2902788 | 8/1980 | Fed. Rep. of Germany . | |
| 51-71254 | 6/1976 | Japan | 72/250 |
| 55-22500 | 2/1980 | Japan | 72/365 |
| 1226504 | 3/1971 | United Kingdom . | |
| 1498851 | 1/1978 | United Kingdom . | |
| 1582258 | 1/1981 | United Kingdom . | |

OTHER PUBLICATIONS

Stahl & Eisen, Sep. 9, 1948, "State of Knowledge in the Area of Hot Forming" by T. Dahl, pp. 333–345.

"Developments in Rolling Mill Technology"–The Metals Society International Conference, E. C. Hewitt, Sep. 1979.

Nippon Steel Technical Report No. 16, Dec. 1980, pp. 88–102.

*Primary Examiner*—Daniel C. Crane

*Assistant Examiner*—Jonathan L. Scherer

*Attorney, Agent, or Firm*—Thompson, Birch, Gauthier & Samuels

[57] ABSTRACT

A high reduction method and apparatus for continuously hot rolling a product through a plurality of roll passes, wherein the distribution of horizontal forces in at least one roll pass other than the first is such that spontaneous entry is prevented by a maximum momentary opposing force which is greater than the available delivery force of the preceding roll pass. An additional force is exerted on the product in advance of the preceding roll pass. This additional force, when combined with the available delivery force of the preceding roll pass, is of sufficient magnitude to overcome the maximum momentary opposing force of the said one roll pass and thus achieve forced entry therein.

15 Claims, 10 Drawing Figures

(FORCED ENTRY)

(ZONE $Z_2$ FORWARD SLIP)

(CONVENTIONAL SPONTANEOUS ENTRY)

(ZONE $Z_1$ BACKWARD SLIP)

(FORCED ENTRY)
$D_{max}$ - FREE ROLLING
$D_{min}$ - FORCED ROLLING (CONVENTIONAL SPONTANEOUS ENTRY)
$D_{max}$ - FREE ROLLING
$D_{min}$ - FREE ROLLING

HIGH REDUCTION METHOD AND APPARATUS FOR CONTINUOUSLY HOT ROLLING PRODUCTS

CROSS-REFERENCE TO RELATED APPLICATION

This application is a continuation-in-part of U.S. Ser. No. 156,940 filed June 6, 1980 and now abandoned.

BACKGROUND OF THE INVENTION

This invention relates to a method and apparatus for achieving high reduction continuous hot rolling of ferrous and non-ferrous products such as billets, bars, rods and the like in a compact series of roll passes.

In any rolling operation, the work rolls exert pressure on the product passing through the roll pass. This pressure is accompanied by frictional forces resulting from the difference in speed between the metal being rolled and the roll surfaces. The vertical components of roll pressure and friction act to reduce the height of the product. The horizontal components of roll pressure act opposite to the direction of rolling and tend to eject metal from the roll gap, whereas the horizontal components of frictional forces act in the direction of rolling in the zone of backward slip and tend to draw the product into the roll gap. In the following discussion, forces acting on the product in the direction of rolling will be considered as positive forces, and those acting on the product opposite to the direction of rolling will be considered as negative forces.

As a product leading end enters a roll pass, the algebraic sum of the horizontal force components of roll pressure and friction will undergo a continuous change from the time that the leading end initially contacts the rolls until it emerges from the roll gap. If this sum remains positive throughout this entry stage, the leading end will be gripped by the work rolls and drawn into and through the roll gap, and this will occur without assistance from any additional force. This condition will be referred to hereinafter as "spontaneous entry".

On the other hand, if the algebraic sum of horizontal force components achieves a negative value during the entry stage, then additional force must be exerted on the product in advance of the roll pass in order to achieve entry. This condition will be referred to hereinafter as "forced entry".

After the roll gap is filled and a condition of equilibrium has been reached, the sum of these horizontal force components will equal zero.

It has been established theoretically that spontaneous entry will occur if the bite angle $\alpha$ is kept within the range $$0<\alpha\leqq\rho$$

where $\rho$ is the angle of friction.

Conversely, a condition of forced entry will exist where $$\alpha>\rho$$

It has also been established that once a leading end has entered the roll pass and the roll gap is filled, free rolling will continue within the theoretical limits $$0<\alpha\leqq 2\rho$$

As herein employed, the term "free rolling" means rolling without using additional force to push or pull the product through the roll pass after the roll gap is filled. If the bite angle exceeds the theoretical limits for free rolling, a continuous additional force must be exerted on the product, even after the roll gap is filled. This condition is referred to hereinafter as "forced rolling".

In the past, the rolling schedules of continuous mills have conventionally operated under conditions of spontaneous entry and free rolling. Absent equipment failures or other unusual circumstances, this approach provides for a smooth passage of the product from one roll pass to the next, which of course is an essential requirement for successful mill operation.

However, it is also known that in any given roll pass, the reduction taken is directly proportional to the magnitude of the cosine of the bite angle. Thus, it will be appreciated that in conventional mills, by limiting the size of the bite angles to accommodate spontaneous entry, considerably less than maximum reductions are taken once the roll gaps are filled. If less than the maximum reductions are taken at the roll passes, their number must be increased in order to achieve a given total reduction.

The additonal roll passes and their associated drives, controls, lubricating and water cooling systems, etc. are extremely costly. The additional roll passes also contribute significantly to mill operating and maintenance costs, while occupying more building space, which is itself a high cost factor in any given mill installation. This latter expense is compounded in many mills by the provision of substantial interstand spacing.

As the costs of rolling equipment, buildings, energy, etc. continue to increase, there is a growing demand for more efficient high reduction rolling methods employing compact smaller sized equipment.

The idea of achieving higher reductions in the roll passes of rolling mills is not in itself new, and over the years those skilled in the art have advanced several proposals for doing so, including for example continuously forcing products through roll passes defined by undriven work rolls (U.S. Pat. No. 723,834) as well as through roll passes defined by driven work rolls (U.S. Pat. No. 4,106,318). However, a problem with these proposals is that they entail the use of relatively large diameter work rolls, which in turn require massive bearings, housings, mill foundations, etc., and large mill buildings. Thus any benefits derived from achieving higher reductions are largely offset by higher capital costs.

In another proposal disclosed in U.S. Pat. No. 3,553,997, high reductions are sought by employing relatively small diameter driven work rolls. Here, however, the roll gaps are initially opened to freely accept each front end, after which the roll gaps are closed to roll the remainder of the product. The impracticability of constantly opening and closing roll gaps, and the waste resulting from the scrapping of unrolled front ends, makes this method inapplicable to modern high tonnage rolling operations.

Other proposals for achieving high reductions include swing forges and planetary mills. While these approaches have met with some limited success in specialized low tonnage applications, they have not achieved widespread acceptance by the rolling mill industry.

SUMMARY OF THE PRESENT INVENTION

The present invention provides a method and apparatus for continuously hot rolling a product through a succession of roll passes while affecting dramatically increased reductions as compared with conventional rolling operations, thereby making it possible to decrease the number of roll passes required to achieve a given total reduction. Rolling is carried out with relatively small diameter work rolls, thereby making it possible to significantly reduce the physical dimensions of the rolling system. This has been accomplished by abandoning the concept of spontaneous entry in at least one and preferably all of the roll passes other than the first in a given series, and by resorting instead to drastic forced entry techniques in order to maximize bite angles and resulting reductions. In at least one of the roll passes, the bite angle is maximized to a degree such that spontaneous entry is prevented by a momentary opposing force which is greater than the available delivery force generated by the rolling action of the preceding roll pass, thus making it necessary to push the product through the preceding roll pass with an additional force exerted in advance thereof.

Preferably, a pass sequence designed in accordance with the present invention will include at least four roll passes, with the bite angle of the first roll pass being sized to accommodate spontaneous entry of the product leading end, with the bite angles of the second and third roll passes being sized to achieve progressively greater reductions under forced entry conditions, and with the force required to achieve entry at the third roll pass being greater than the available delivery force generated by the rolling action of the second roll pass, thus requiring assistance from the available delivery force of the first roll pass. The fourth roll pass also operates under forced entry conditions, but for reasons which will hereinafter be explained, its bite angle and resulting reduction are lower than those of the third roll pass.

For a given set of conditions, once the roll gaps of all roll passes are filled, free rolling will take place. However, depending on certain variables, such as for example the prevalent coefficient of friction and/or the extent that roll diameters have been permitted to decrease because of normal wear and conventional dressing, the bite angle of the third roll pass may eventually increase to a degree such that free rolling will no longer be possible, thus necessitating forced rolling in the third roll pass by continuous assistance initially from the second roll pass, and thereafter from the fourth roll pass once the tail end clears the second roll pass.

Preferably, the roll axes of successive roll passes will be arranged at right angles relative to each other, with the rolls being grooveless.

In order to conserve space and to derive maximum benefit from the column strength of the product being rolled, the spacing between successive roll passes is kept to an absolute minimum, preferably between 1.0–2.0 times the maximum roll diameter.

DETAILED DESCRIPTION OF THE INVENTION

Figure 2B:
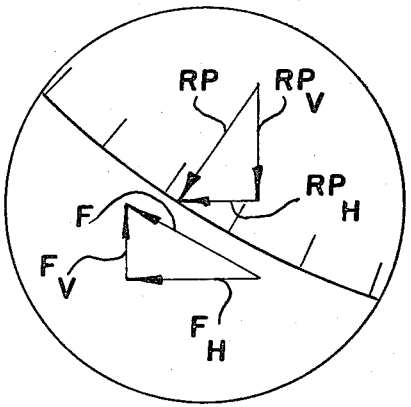
FIGS. 2A and 2B are greatly enlarged schematic views taken respectively at a zone $Z_1$ of backward slip and a zone $Z_2$ of forward slip in either FIG. 1A or FIG. 1B.
Figure 1A:
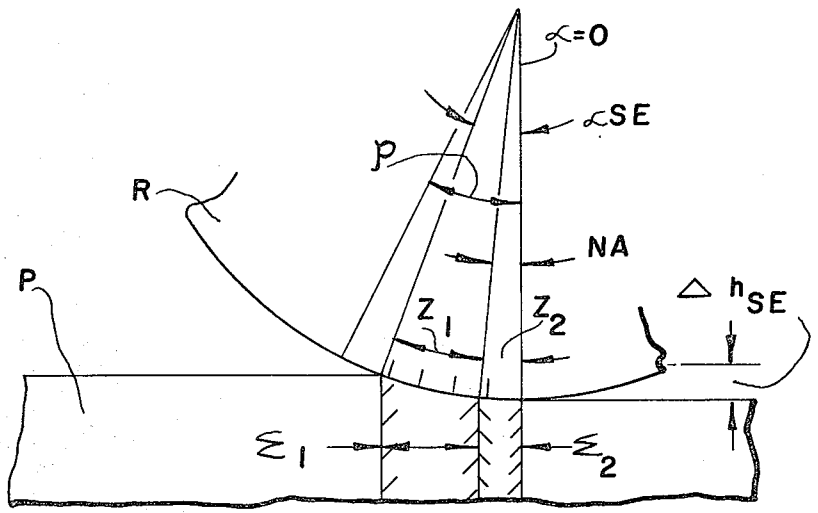
FIG. 1A is a diagrammatic illustration showing rolling under conventional spontaneous entry conditions.
Figure 2A:
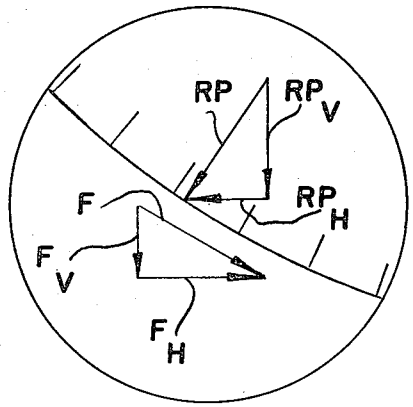

Since the work rolls of a given pair operate under identical conditions, a description of one will suffice for both. Referring initially to FIGS. 1A, 2A and 2B, one work roll R of a given roll pair is shown rolling a product P under conventional spontaneous entry conditions, with a bite angle $\alpha_{SE}$ which is less than the friction angle $\rho$. The product is subjected simultaneously to roll pressure RP and friction F. Roll pressure RP may be resolved into a vertical force component $RP_V$ acting normal to the direction of rolling and a negative horizontal force component $RP_H$ acting opposite to the direction of rolling. Likewise, friction F may be resolved into a vertical force component $F_V$ and a horizontal force component $F_H$. The vertical force components $RP_V$ and $F_V$ affect a reduction $\Delta h_{SE}$ in product height h. FIG. 2A shows that in a zone $Z_1$ of backward slip, the horizontal components $F_H$ acts positively, whereas FIG. 2B shows that in a zone $Z_2$ of backward slip, the horizontal components $F_H$ acts negatively. The reversal of this component from positive to negative occurs at the neutral angle NA which serves as the division between zones $Z_1$ and $Z_2$.

Figure 3B:
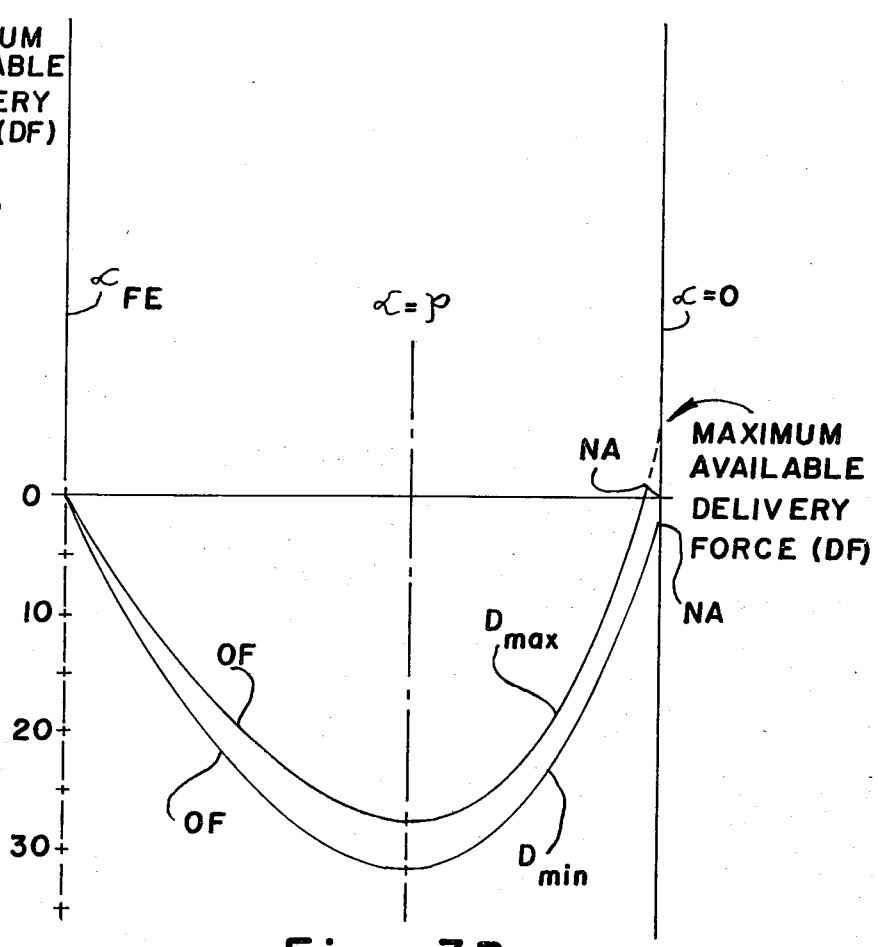
FIG. 3B is a graph similar to FIG. 3A showing the summation of horizontal force components under the forced entry conditions of FIG. 1B, with forced rolling occurring during the use of minimum roll diameters.
Figure 3A:
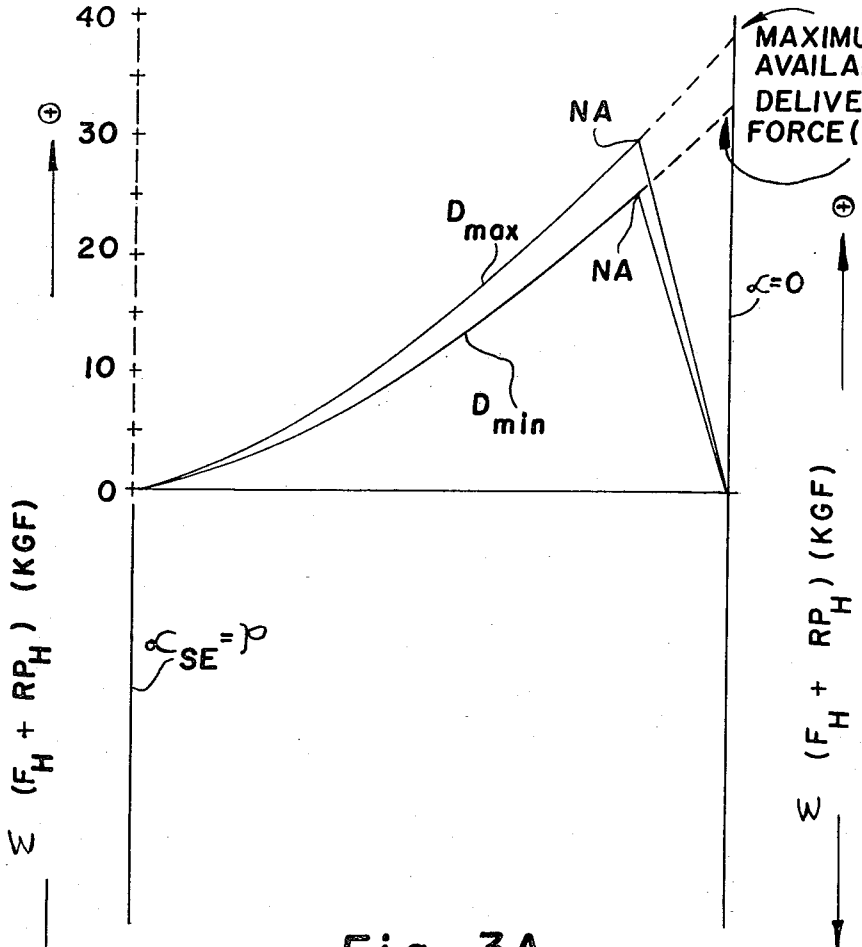
FIG. 3A is a graph showing the summation of horizontal force components under the spontaneous entry conditions of FIG. 1A.

As shown in FIG. 3A, when rolling under conventional spontaneous entry conditions, the algebraic sum $\Sigma$ of the horizontal force components $RP_H$ and $F_H$ remains positive at all times during introduction of the product leading end into the roll gap. The curves $D_{max}$ and $D_{min}$ in FIG. 3A show typical conditions for both maximum and minimum diameter rolls. After reaching the neutral angle, the values of $\Sigma$ drop to zero at $\alpha=0$, thereby establishing a condition of equilibrium in the roll bite. However, in the event that rolling in the bite is opposed by an external force (for example a negative opposing force being generated in a subsequent roll pass) then in order to reestablish a condition of equilibrium, the neutral angle will shift towards zero (along the dotted lines in FIG. 3A), thereby generating an available delivery force DF to overcome the external force. The maximum available delivery force occurs when the neutral angle reaches the zero limit at $\alpha=0$.

Figure 1B:
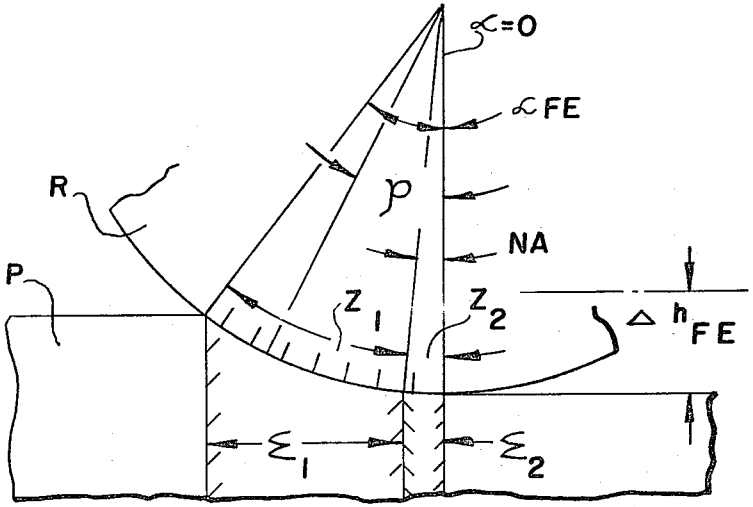
FIG. 1B is a view similar to FIG. 1A showing rolling under forced entry conditions.

FIG. 1B shows a work roll R rolling the product P under forced entry conditions in accordance with one aspect of the present invention, with a bite angle $\alpha_{FE}$ larger than the friction angle working to achieve a larger reduction in product height $\alpha h_{FE}$. During an initial negative stage of product entry, $RP_H$ will exceed $F_H$. Thus, as shown in FIG. 3B, the sum of horizontal force components initially will take on an increasingly negative value, producing an increasing negative opposing force OF which reaches a maximum value at the friction angle $\rho$. In a subsequent positive stage of entry, $F_H$ begins to exceed $RP_H$, and the value of $\Sigma$ begins to move in the positive direction. In order to achieve entry, the negative value of $\Sigma$ at any given point during introduction of the leading end into the roll gap must be overcome by the exertion of an additional positive force on the product in advance of the roll pass, thus resulting in a forced entry condition. In the present invention, this additional positive force is supplied by the available delivery force of one or more preceding roll passes as their respective neutral angles NA shift towards zero. When employing new rolls having a diameter $D_{max}$, the neutral angle NA is greater than zero, and eventually the value of $\Sigma$ reaches zero at $\alpha=0$. Free rolling thus occurs under conditions of equilibrium in the roll pass. However, as roll diameters decrease to $D_{min}$, the value of $\Sigma$ may be negative at $\alpha=0$, thus resulting in a forced rolling condition during which an additional force must be exerted continuously on the product to overcome the negative DF after the roll gap is filled.

Figure 4:
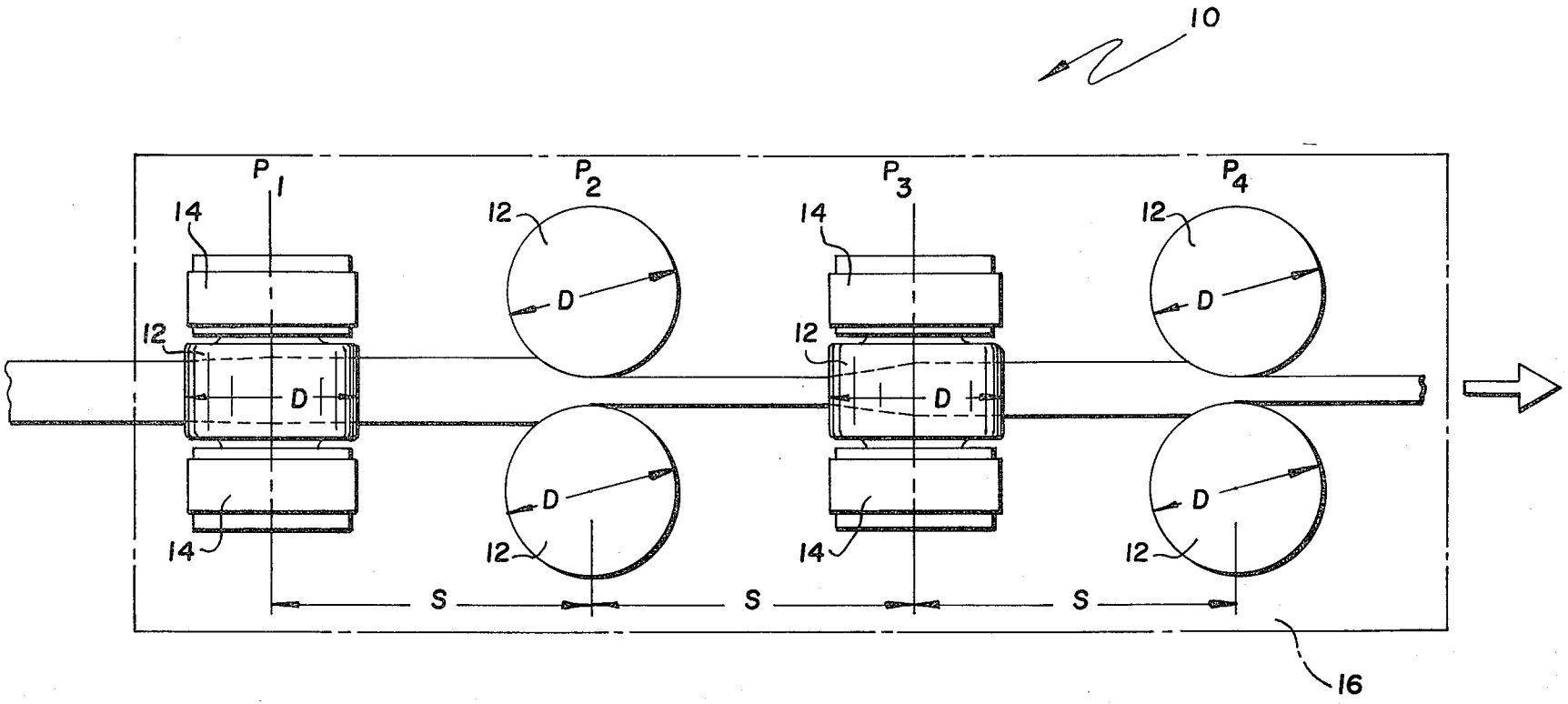
FIG. 4 is a schematic illustration of an apparatus in accordance with the present invention.

Referring now to FIG. 4, an apparatus in accordance with the present invention is schematically depicted at 10. The apparatus includes a succession of roll passes $P_{1-4}$ defined by cooperating pairs of work rolls 12. The work rolls of each roll pass are driven by conventional means (not shown). The work rolls 12 are supported between bearings 14 (only the horizontal roll bearings being shown), and these in turn are supported by a housing structure schematically represented at 16. The work rolls are preferably grooveless with a diameter D ranging from a maximum $D_{max}$ for new rolls to a minimum $D_{min}$ for rolls which have been subjected to the maximum permissible number of dressing operations. The spacing S between roll passes is kept to an absolute minimum, preferably between 1.0–2.0 times the maximum roll diameter $D_{max}$ of new rolls. The roll axes of successive roll passes are arranged at right angles relative to each other, thereby eliminating any need to twist the product as it progresses from one roll pass to the next.

Figure 5:
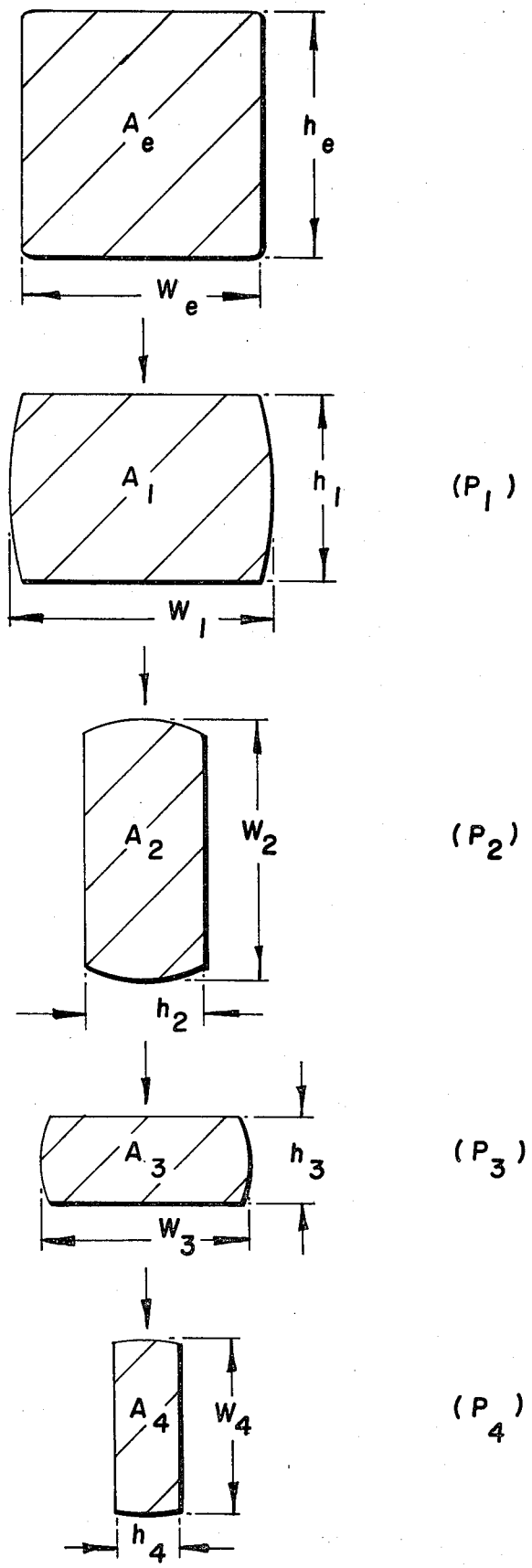
FIG. 5 is an illustration of a typical rolling sequence in accordance with the present invention.

FIG. 5 illustrates a typical rolling sequence of the present invention, where h=product height (measured perpendicular to the roll axes), w=product width (measured parallel to the roll axes), and A=cross section area. The entering section is typically a square billet having slightly rounded corners, with equal height and width dimensions $h_e$, $w_e$ and a cross sectional area $A_e$. This entering section is reduced in roll pass $P_1$ to a horizontally oriented round edged rectangle measuring $h_1$, $w_1$ with a reduced cross sectional area $A_1$. As herein employed, the term "round edged rectangle" defines a generally rectangular cross section with two opposed substantially flat sides and two opposed slightly convex sides.

Roll pass $P_2$ further reduces the product to a vertically oriented round edged rectangle measuring $h_2$, $w_2$ with a cross sectional area $A_2$. Roll pass $P_3$ again reduces the product to another horizontally oriented round edged rectangle measure $h_3$, $w_3$ with a cross sectional area $A_3$. The final roll pass $P_4$ rolls the product down to another vertically oriented round edged rectangle measuring $h_4$, $w_4$ with a cross sectional area $A_4$.

Preferably, the aspect ratios achieved in roll passes $P_2$, $P_3$ and $P_4$ are within the ranges specified in U.S. Pat. No. 4,050,280.

An example of the method of the present invention now will be described in connection with the rolling of a 180×180 mm. steel billet in four passes under the following rolling conditions:

| | |
|---|---|
| Production rate | 100 MTPH |
| Entering speed | 0.11 M/sec. |
| Entering Temperature | 1100° C. |
| Coefficient of Friction ($\mu$) | 0.38 |

Figure 6:
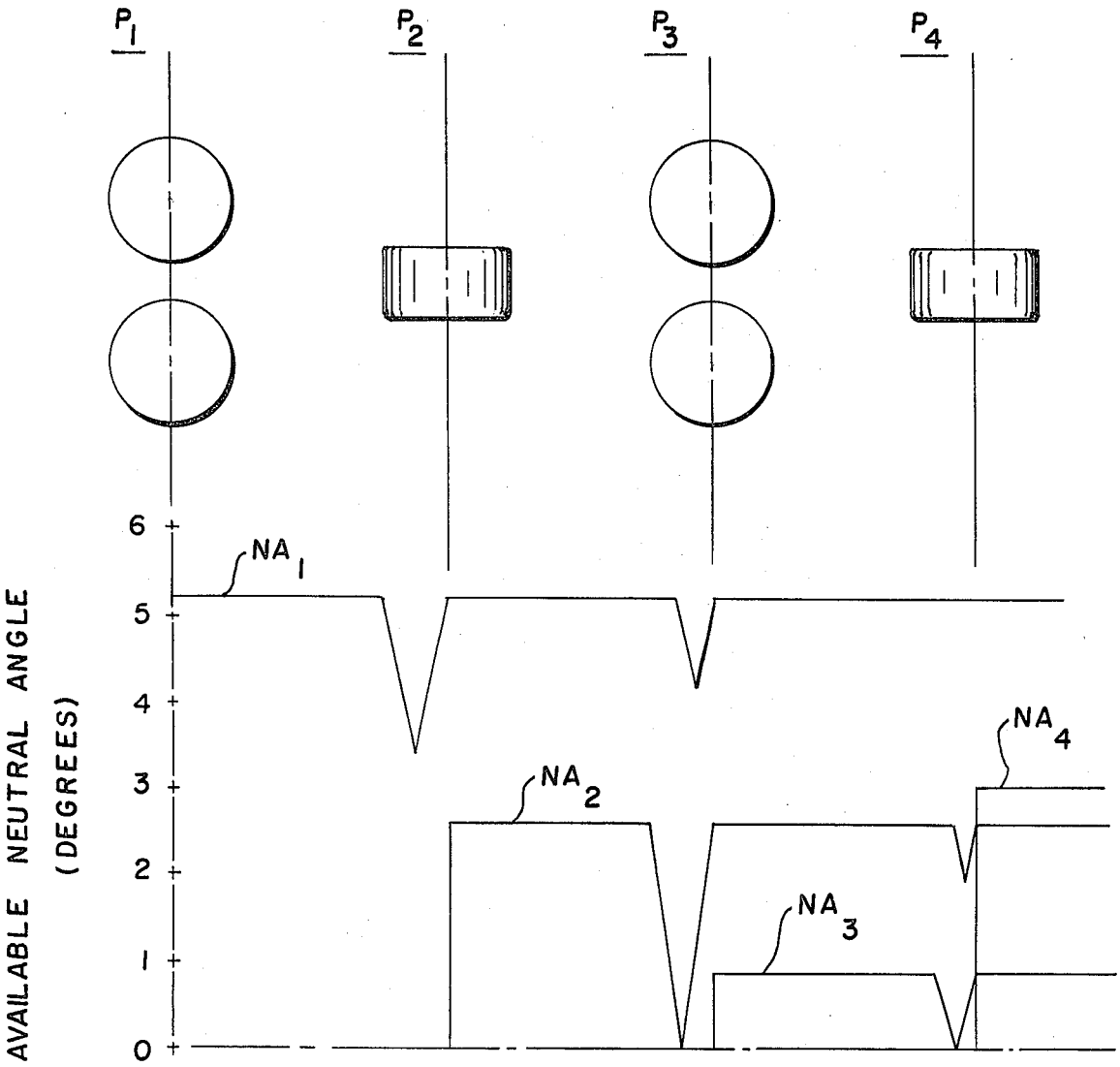
FIG. 6 is a typical diagrammatic illustration showing the history of movement of the neutral angle in each stand to maintain equilibrium in a rolling system of the present invention.

When using new rolls with a $D_{max}$ of 510 mm, FIG. 6 illustrates how the neutral angles of each pass undergo changes during rolling. Other pertinent data for each of the four roll passes is tabulated in Table I.

TABLE I

| | (D = 510 mm) | | | |
|---|---|---|---|---|
| | $P_1$ | $P_2$ | $P_3$ | $P_4$ |
| h (mm) | 146.8 | 87.6 | 63.3 | 46.8 |
| w (mm) | 189.6 | 201.7 | 145.7 | 107.7 |
| $\alpha$ | 20.8 | 36.9 | 43.2 | 36.3 |
| r | 12.9 | 36.5 | 47.8 | 45.3 |
| NA | 5.21 | 2.59 | 0.86 | 3.00 |
| OF | 0 | −20454 | −27531 | −11209 |
| DF | +38590 | +21815 | +5872 | +17617 |
| ENTRY | Spont. | Forced | Forced | Forced |
| ROLLING | Free | Free | Free | Free |

h = product height
w = product width
$\alpha$ = bite angle in degrees
r = percentage reduction in area
OF = maximum opposing force (KGF)
DF = maximum available delivery force (KGF)
NA = neutral angle in degrees h=product height
w=product width
$\alpha$=bite angle in degrees
r=percentage reduction in area
OF=maximum opposing force (KGF)
DF=maximum available delivery force (KGF)
NA=neutral angle in degrees Beginning at the first roll pass $P_1$, it will be seen that a relatively modest bite angle $\alpha_1$ of 20.8° has been selected to provide for spontaneous entry of the leading end. The percentage of reduction $r_1$ is a relatively modest 12.9%, and the resulting available delivery force $DF_1$ can reach a maximum of 38590 KGF if the neutral angle NA shifts from 5.21 to zero. The $D_{max}$ curve of FIG. 3A is representative of this rolling condition.

The second roll pass $P_2$ has a larger bite angle $\alpha_2$ of 36.9°, which results in an increased percentage of reduction $r_2$ of 36.5%. Here, the distribution of horizontal force components is such that spontaneous entry is prevented by a maximum opposing force $OF_2$ of 20454 KGF. However, forced entry is accomplished in roll pass $P_2$ by overcoming $OF_2$ with a portion of the available delivery force $DF_1$ from roll pass $P_1$ as the neutral angle of that pass shifts towards zero. The product exits from roll pass $P_2$ under equilibrium conditions with a neutral angle of 2.59° and a capability of developing a maximum available delivery force of 21815 KGF. It will be appreciated from FIG. 3B that under free rolling conditions the opposing forces OF are only momentary in nature and occur during the initial stages of product entry.

The third roll pass $P_3$ has a still larger bite angle $\alpha_3$ of 43.2°, which produces a drastic reduction $r_3$ of 47.8%. Here, the distribution of horizontal force components is such that spontaneous entry is prevented by a maximum opposing force $OF_3$ of 27531 KGF, which substantially exceeds the available delivery force $DF_2$ of the preceding roll pass $P_2$. In order to achieve forced entry in roll pass $P_3$, $DF_2$ must be augmented by an additional available delivery force exerted on the product in advance of roll pass $P_2$. This additional available force is derived from $DF_1$, i.e., $OF_3 > DF_2$ but $DF_1 + DF_2 > OF_3$. Thus, forced entry is achieved in roll pass $P_3$ with horizontal delivery forces derived from the rolling action of roll passes $P_1$ and $P_2$. As shown in FIG. 6, while this is occurring, the neutral angle of roll pass $P_2$ will shift from 2.59° to zero and the neutral angle of roll pass $P_1$ will shift from 5.21° towards zero. The product exits from roll pass $P_3$ under equilibrium conditions with a neutral angle of 0.86° and a maximum available delivery force $DF_3$ of 5872 KGF. This forced entry—free rolling condition is typified by the $D_{max}$ curve of FIG. 3B.

The fourth roll pass $P_4$ has a bite angle $\alpha_4$ of 36.3°, which produces a reduction $r_4$ of 45.3% and an opposing force $OF_4$ of 11209 KGF. The force required to achieve entry in roll pass $P_4$ is once again derived from the combined available delivery forces $DF_2$ and $DF_3$, with the neutral angle NA of roll pass $P_3$ shifting from 0.86° to zero and the neutral angle NA of roll pass $P_2$ shifting towards zero. The product exits from roll pass $P_4$ under equilibrium conditions, with a neutral angle NA of 3.00° and a maximum available delivery force of 17617 KGF.

As the work rolls wear and require redressing, their diameters gradually will decrease, and this in turn will have an effect on the bite angles, percentages of reduction and force distributions at each roll pass. For the example described above, a reduction in roll diameters down to 435 mm is considered feasible. The rolling conditions at each roll pass with 435 mm rolls is tabulated in Table II.

TABLE II

| | (D = 435 mm) | | | |
|---|---|---|---|---|
| | $P_1$ | $P_2$ | $P_3$ | $P_4$ |
| h (mm) | 151.6 | 93.1 | 67.2 | 48.3 |
| w (mm) | 187.8 | 200.4 | 148.2 | 111.2 |
| $\alpha$ | 20.8 | 38.5 | 46.1 | 39.6 |
| r | 11.0 | 34.5 | 46.6 | 46.1 |
| NEUTRAL ANGLE | 5.21 | 2.00 | −.36 | 2.05 |
| OF | 0 | −21781 | −31380 | −15052 |
| DF | +32668 | +14332 | −2142 | +10693 |
| ENTRY | Spont. | Forced | Forced | Forced |
| ROLLING | Free | Free | Forced | Free |

A comparison of Tables I and II shows that a reduction of the work roll diameters to 435 mm will result in the bite angles $\alpha$ at each roll pass being increased, with accompanying decreases in the delivery forces DF and increases in the maximum opposing forces OF. The most dramatic shift occurs at roll pass $P_3$ where even after the roll gap has been filled, free rolling is opposed by a negative delivery force $DF_3$ of 2142 KGF. Under this forced entry—forced rolling condition at roll pass $P_3$ (typified by the $D_{min}$ curve in FIG. 3B), the negative delivery force $DF_3$ will be overcome by the available delivery force $DF_2$ until the product tail end clears roll pass $P_2$. Thereafter, the negative delivery force $DF_3$ will be overcome by the delivery force $DF_4$ of roll pass $P_4$. It will thus be understood that when a forced rolling condition is encountered at roll pass $P_3$, it is essential to maintain a free rolling condition at roll pass $P_4$ in order to insure that the product tail end is pulled through pass $P_3$. It is for this reason that the bite angle of roll pass $P_4$ is kept smaller than that of roll pass $P_3$.

During forced entry of the product leading end into roll pass $P_4$, its maximum opposing force $OF_4$ and the negative delivery force $DF_3$ of roll pass $P_3$ are jointly overcome by the combined delivery forces $DF_1$ and $DF_2$ of roll passes $P_1$ and $P_2$.

Tables III and IV illustrate some of the changes to be expected when rolling the same product with a higher coefficient of friction of 0.4.

TABLE III

| | (D = 510 mm) | | | |
|---|---|---|---|---|
| | $P_1$ | $P_2$ | $P_3$ | $P_4$ |
| h (mm) | 143.5 | 86.4 | 62.5 | 46.3 |
| w (mm) | 190.7 | 199.1 | 143.9 | 106.5 |
| $\alpha$ | 21.8 | 37.3 | 42.9 | 36.0 |
| r | 14.4 | 37.2 | 47.7 | 45.2 |
| N.A. | 5.50 | 3.12 | 1.71 | 3.60 |
| OF (KGF) | 0 | −18783 | −24346 | −9460 |
| DF (KGF) | +42888 | +27276 | +12131 | +22091 |
| ENTRY | Spont. | Forced | Forced | Forced |
| ROLLING | Free | Free | Free | Free |

TABLE IV

| | (D = 495 mm) | | | |
|---|---|---|---|---|
| | $P_1$ | $P_2$ | $P_3$ | $P_4$ |
| h (mm) | 144.6 | 86.7 | 62.5 | 46.2 |
| w (mm) | 190.2 | 199.6 | 144.1 | 106.3 |
| $\alpha$ | 21.8 | 37.7 | 43.7 | 36.6 |
| r | 14.0 | 37.1 | 48.0 | 45.5 |
| NA | 5.46 | 2.99 | 1.46 | 3.47 |
| OF (KGF) | 0 | −19433 | −25507 | −10060 |
| DF (KGF) | +41580 | +25506 | +10112 | +20759 |
| ENTRY | Spont. | Forced | Forced | Forced |
| ROLLING | Free | Free | Free | Free |

Table III shows that with a higher coefficient of friction and maximum diameter rolls, it may be possible to achieve forced entry in roll pass $P_3$ by relying on the available delivery force $DF_2$ of roll pass $P_2$. The margin of safety, however, is practically non-existent, and soon vanishes as roll diameters decrease as a result of normal wear. At a D of 495 mm, forced entry in roll pass $P_3$ again requires the combined available delivery forces of roll passes $P_1$ and $P_2$.

Table V illustrates that for the examples of Tables I–IV, at any given roll pass requiring forced entry, the ratio of available positive delivery forces DF to maximum negative opposing forces (sometimes augmented by negative delivery forces during forced rolling) purposely has been kept such as to provide a reserve factor of at least 1.5.

TABLE V

| | $P_2$ | $P_3$ | $P_4$ |
|---|---|---|---|
| | $\frac{DF_1}{OF_2}$ | $\frac{DF_1 + DF_2}{OF_3}$ | $\frac{DF_2 + DF_3}{OF_4}$ |
| D = 510 mm, $\mu$ = 0.38 | 1.89 | 2.19 | 2.47 |
| D = 435 mm, $\mu$ = 0.38 | 1.50 | 1.50 | 2.73* |
| D = 510 mm, $\mu$ = 0.40 | 2.28 | 2.88 | 4.16 |
| D = 495 mm, $\mu$ = 0.40 | 2.14 | 2.63 | 3.54 |

*$OF_4$ augmented by negative $DF_3$ during forced rolling.

A reserve factor of this magnitude is considered to be more than ample to insure continuous rolling as conditions such as product temperature, coefficient of friction, etc. undergo normal variations.

Table VI shows the average reduction per pass and total reduction per series for the examples discussed above.

TABLE VI

| | Average Red. Per Roll Pass | Total Reduction |
|---|---|---|
| D = 510 mm | | |
| $\mu$ = 0.38 | 37% | 84.2% |
| D = 435 mm | | |
| $\mu$ = 0.38 | 36% | 83.3% |
| D = 510 mm | | |
| $\mu$ = 0.40 | 37.4% | 84.6% |
| D = 495 mm | | |
| $\mu$ = 0.40 | 37.4% | 84.6% |

By comparison, if a four pass sequence of the prior art rolling method disclosed in U.S. Pat. No. 4,050,280 was employed under similar rolling conditions with spontaneous entry and free rolling, the maximum reduction possible with 435 mm rolls would be 64.4%. Those skilled in the art will thus appreciate that the present invention provides a truly significant advance in the art of rolling.

The importance of relying on the available delivery forces of two successive roll passes to achieve forced entry in a downstream pass will be seen by referring for example to Table II, where if only $DF_2$ is used to overcome $OF_3$, then with a reserve factor of 1.5, $$OF_3 = \frac{DF_2}{1.5} = \frac{14332}{1.5} = 9555 \text{ KGF}$$

Under these conditions, it would be necessary to limit $\alpha_3$ to 35.8°, yielding a much lower percentage of reduction of 26.2% at roll pass $P_3$, thus limiting the total reduction to 69.2% (assuming a width to height ratio of 2.3 at $P_4$).

Figure 7:
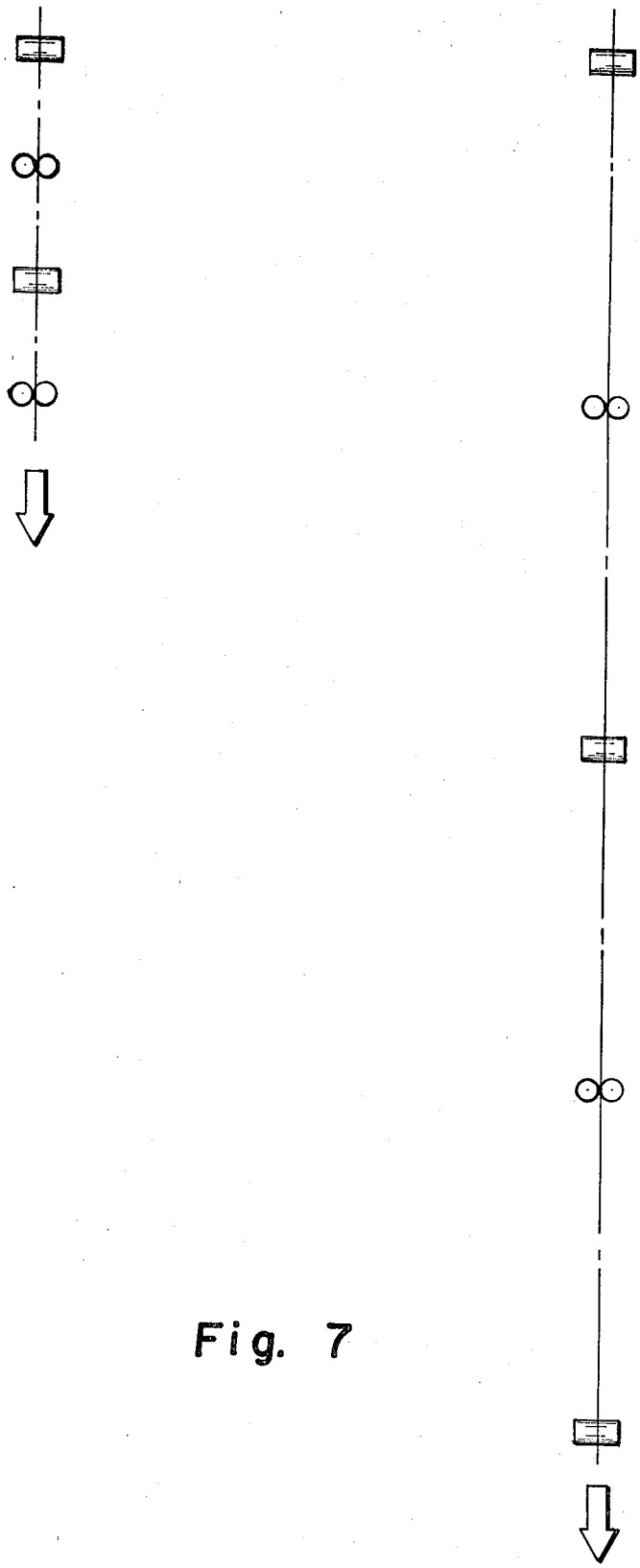
FIG. 7 is a diagrammatic illustration comparing a four roll pass sequence of the present invention with a conventional roll pass sequence required to achieve the same reduction on the same product.

In FIG. 7, the four roll pass unit of FIG. 1 is compared with a conventional continuous rolling mill installation. The conventional mill employs 700 mm rolls, with the roll stands spaced at 3000 mm. intervals, and with each roll pass being designed for spontaneous entry and free rolling conditions. If the same product is rolled by both mills, for example a 180×180 mm steel billet reduced to approximately a 47×108 mm rectangle, the conventional mill will require an additional roll pass. Moreover, approximately 75% more building space will be required to house the conventional mill equipment.

It will thus be seen that the present invention provides a highly efficient method and apparatus for continuously rolling a product, having the capability of achieving higher reductions with less equipment and within less space than has heretofore been possible with conventional methods and equipment.

I claim:

1. A high reduction method of continuously hot rolling a product, comprising: passing the product through a series of at least three roll passes and effecting in said roll passes progressively larger reductions on the product, with at least two successive roll passes in said series having their roll axes arranged at right angles relative to each other, and with the distribution of horizontal forces in at least the third roll pass being such that spontaneous entry is prevented in said third roll pass by a maximum opposing force which is greater than the available delivery force generated by the rolling action of the second roll pass; and employing the available delivery force of the first roll pass to exert an additional momentary force on the product in advance of the second roll pass, the said additional momentary force being of sufficient magnitude when combined with the available delivery force of the second roll pass to overcome said maximum opposing force and thus achieve forced entry of the product in said third roll pass.

2. The method of claim 1 wherein the rolls of said roll passes are grooveless.

3. The method of claim 1 wherein a free rolling condition exists in said third roll pass following forced entry of the product therein.

4. The method of claim 1 wherein a forced rolling condition exists in said third roll pass following forced entry of the product therein.

5. The method of claim 4 further comprising the use of a fourth roll pass following said third roll pass to exert the additional force needed to achieve forced rolling in said third roll pass after the product tail end has cleared said second roll pass.

6. The method of continuously rolling a product to achieve a maximum reduction in cross-sectional area of said product with a minimum number of roll passes, comprising: passing the product through a series of at least three roll passes and effecting in said roll passes progressively larger reductions on the product, with at least two successive roll passes in said series having their roll axes arranged at right angles relative to each other, with at least the first and second of said roll passes being capable of exerting positive available delivery forces on the product when their respective roll gaps are filled, and with the third of said roll passes having a distribution of horizontal force components such that spontaneous entry of the product is prevented in said third roll pass by a momentary maximum opposing force which is greater than the available delivery force of said second roll pass, but less than the sum of the available delivery forces of said first and second roll passes, and momentarily employing a portion of the available delivery force of said first roll pass as an addition to the available delivery force of the second roll pass to overcome said momentary maximum opposing force and thereby achieve forced entry of the product in said third roll pass.

7. The method of claim 6 wherein the second of said roll passes has a distribution of horizontal force components such that spontaneous entry is prevented by a maximum opposing force which is less than the available delivery force of said first roll pass.

8. The method of claim 6 wherein the reduction achieved in said third roll pass is at least 40%.

9. The method of claim 6 further comprising the use of a fourth roll pass immediately following said third roll pass, said fourth roll pass having a distribution of horizontal force components such that spontaneous entry is prevented by a maximum momentary opposing force which is overcome by the available delivery force of a preceding roll pass, and with the distribution of horizontal force components in said fourth roll pass after the roll gap is filled being such that free rolling takes place.

10. The method of claim 9 whereupon following forced entry of the product into said third roll pass a forced rolling condition exists in said third roll, thus requiring the continuous exertion of an additional force on the product by the rolling action of at least one other roll pass.

11. The method of claim 10 wherein the additional force required to achieve forced entry of the product in said fourth roll pass is derived at least in part from the available delivery force of said second roll pass.

12. Apparatus for continuously hot rolling a product, comprising: a series of at least three roll passes which effect progressively larger reductions on the product, with at least two successive roll passes in said series having their roll axes arranged at right angles relative to each other, the third of said roll passes having an angle of bite such that spontaneous entry of the product therein is prevented by a maximum opposing force which is greater than the available delivery force generated by the rolling action of the second roll pass; the available delivery force of the first roll pass being sufficient to exert a momentary additional force on the product in advance of said third roll pass, the said momentary additional force being of sufficient magnitude when combined with the available delivery force of said second roll pass to overcome said maximum opposing force and thus achieve forced entry of the product in said third roll pass.

13. The apparatus of claim 12 wherein the rolls of said roll passes are grooveless.

14. The apparatus of claim 12 wherein the angle of bite of said third roll pass is such that a free rolling condition exists following forced entry of the product therein.

15. The apparatus of claim 12 wherein the angle of bite in said third roll pass is such that a forced rolling condition exists following forced entry of the product therein.

* * * * *